US006390613B1

(12) United States Patent
Liu

(10) Patent No.: US 6,390,613 B1
(45) Date of Patent: May 21, 2002

(54) INK-REFILLING DEVICE FOR INK CARTRIDGE OF A JET PRINTER

(76) Inventor: Win-Yin Liu, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/784,154

(22) Filed: Feb. 16, 2001

(51) Int. Cl.[7] ..... B41J 2/175
(52) U.S. Cl. ..... 347/85
(58) Field of Search ..... 347/84, 85, 86; 141/18, 21, 25; 215/341, 346, 352; 222/325, 567, 523; 53/467

(56) References Cited

U.S. PATENT DOCUMENTS 5,515,663 A * 5/1996 Allgeier, Sr. et al. ..... 53/467
6,120,138 A * 9/2000 Xiao et al. ..... 347/85
6,213,597 B1 * 4/2001 Liu ..... 347/85

* cited by examiner

*Primary Examiner*—Anh T. N. Vo
(74) *Attorney, Agent, or Firm*—Troxell Law Office PLLC

(57) ABSTRACT

An ink refilling unit for ink cartridge of a jet printer, which comprises an ink cylinder, a vacuum cylinder, and a leak-proof ring, etc.; the ink cylinder is to be refilled with ink; to refill ink into the ink cartridge, the filling nozzle on one end of the ink cylinder is connected with the filling hole of the ink cartridge first; use two fingers of one hand to press the finger-press plate under the ink cylinder, while the other hand can hold the outer surface of the vacuum cylinder, and may pull the vacuum cylinder upwards so as to create a vacuum in the refilling unit; then, the air bubbles in the ink sponge of the ink cartridge will be sucked out first, and ink-refilling operation will start as a result of a negative pressure in the ink cartridge.

10 Claims, 9 Drawing Sheets

INK-REFILLING DEVICE FOR INK CARTRIDGE OF A JET PRINTER

BACKGROUND OF THE INVENTION

1. Field of the Invention

This invention relates to the ink cartridge of a jet printer, and particularly to an ink-refilling unit for ink cartridge of a jet printer.

2. Description of the Prior Art

In the conventional jet printer, the ink is loaded in a cartridge, and the ink jetted on the printing paper is controlled with a sprayer; when ink in the cartridge is used up, the cartridge has to be replaced for further printing operation; however, the ink cartridge supplied by the original manufacturer is considerably expensive, i.e., a user to print a lot of papers will spend a lot of money.

In the conventional ink cartridge of a jet printer, the ink chamber of the ink cartridge is usually loaded with an equalization air bladder or a piece of sponge for soaking and supplying ink. The ink cartridge supplied by the original manufacturer usually has an equal pressure in the ink chamber during the automatic manufacturing process, and there will be no leak during printing operation.

In the conventional ink cartridge loaded with a sponge, an empty ink cartridge can be replenished by sealing and closing the end opening of the output port by means of a glue paper; then, a center through hole on lid of the top surface of the ink cartridge is sealed with a membrane; a syringe is sucked with a suitable amount of ink. A slender hollow needle is used to stab through the membrane on the through hole, and to the most lower portion of the storage chamber so as to inject ink in the storage chamber; however, the sponge in the storage chamber contains a great amount of bubbles, and the ink injected is unable to exhaust the air therein; as a result, the ink injected in is limited. Since there is a mesh furnished between the storage chamber and the second chamber, if air in the second chamber is unable to exhaust, the ink in the storage chamber will be unable to enter the second chamber via the mesh, and the ink will be unable to flow into the spraying chamber.

When the ink cartridge on a printer fails to print continuously, the major cause is that the sprayer in the printing head is in short supply of ink, i.e., lack of sufficient ink flowing through the passage defined by the bearing member; in other words, if too much air enters the second chamber in the printing head, such air would enter the storage chamber of the sprayer to cause interruption of ink, i.e., having no ink to spray out; in the event of no ink to spray out of the sprayer for a considerable time, the sprayer might be burned out.

In the former application Ser. No. 09/328,378, "An apparatus for the ink cartridge of a jet printer" of the applicant, which mainly comprises an ink-storage container and a cylinder; the ink-storage container has a cylindrical body portion, of which the bottle mouth is furnished with a retaining ring and screw threads to be connected with a piston ring and a threaded cap respectively so as to store ink; one end of the cylindrical body portion is furnished with an outer body portion having a large diameter; the cylindrical body portion and the inner cylinder of the cylinder are assembled together; the piston ring of the bottle mouth is in close contact with the inner cylinder; the front end of the sealed surface of the cylinder is furnished with a tapered ink straw to be plugged and connected with a through hole of the ink cartridge; hold the outer surface of the cylinder, and then the thumb pushes the shoulder portion of the ink-storage container upwards so as to generate a negative pressure for replenishing ink into the ink cartridge.

SUMMARY OF THE INVENTION

The prime feature of the present invention is to provide an improvement to an application of "An apparatus for the ink cartridge of a jet printer", Ser. No. 09/328,378; the ink is to be stored in a separate ink cylinder, of which the upper end has a leak-proof ring to be connected with a cylinder body of a vacuum cylinder. When refilling the ink cartridge, the filling nozzle should be connected with the filling hole of the ink cartridge; two fingers of one hand press on the finger-press plate, while the other hand holds the outer surface of the vacuum cylinder to pull upwards so as to have the inside of the refilling unit create a vacuum; then, the air bubbles in the ink sponge of the ink cartridge will be sucked out, and the negative pressure in the ink cartridge will cause ink to be filled therein.

Another feature of the present invention is that a leak-proof ring is furnished between the ink cartridge and the vacuum cylinder, and the center of the leak-proof ring has a through hole. The post hole of the vacuum cylinder mounted on the ink cartridge is connected with the leak-proof ring closely. When the vacuum cylinder is pulled upwards, the inside of the vacuum cylinder will create a vacuum so as to have air in the ink cartridge exhausted; and to have ink filled therein.

Still another feature of the present invention is that a retaining ring is furnished on the upper end of the cylinder body of the ink cylinder, and it is to be connected with a leak-proof ring. The outer surface of the ink cylinder is provided with a plurality of rib-like plates, which can prevent the vacuum cylinder from bias moving upon being pulled over the ink cylinder.

A further feature of the present invention is that the lower end of the ink cylinder is furnished with a finger-press plate, which can be pressed with two fingers. The vacuum cylinder mounted over the ink cylinder can be grasped with hand to pull upwards so as to create a vacuum in the vacuum cylinder. The lower end of the vacuum cylinder has a limit ring to prevent the vacuum cylinder from being pulled off the ink cylinder unintentionally.

A still further feature of the present invention is that the bottom side of the finger-press plate has a cylindrical part with two symmetrical lugs; the finger-press plate may be pressed first to have the cylindrical part pass through the connection hole of the protection box; then, let the lugs mount to the retaining groove of the protection box; the open space of the other end of the protection box is connected with the ink cartridge so as to have the ink cartridge had a safe refilling operation.

Yet another feature of the present invention is that the post hole in the vacuum cylinder has a short post; when the refilling unit is not in use, the short post is plugged into the through hole of the leak-proof ring on the upper end of the ink cylinder so as to have ink stored and sealed in the inner cylinder of the ink cylinder.

Yet still another feature of the present invention is that the center of the short post in the vacuum cylinder has a post hole, which is normally closed with a hole plug to prevent ink from leaking. After refilling operation, the hole plug can be pulled out by pulling a pull plate, and then the post hole is used as a refilling hole so as to have the ink in an ink bottle filled into the ink cylinder; the refilling unit can be used repeatedly.

DETAILED DESCRIPTION OF THE PREFERRED EMBODIMENT

Figure 1:
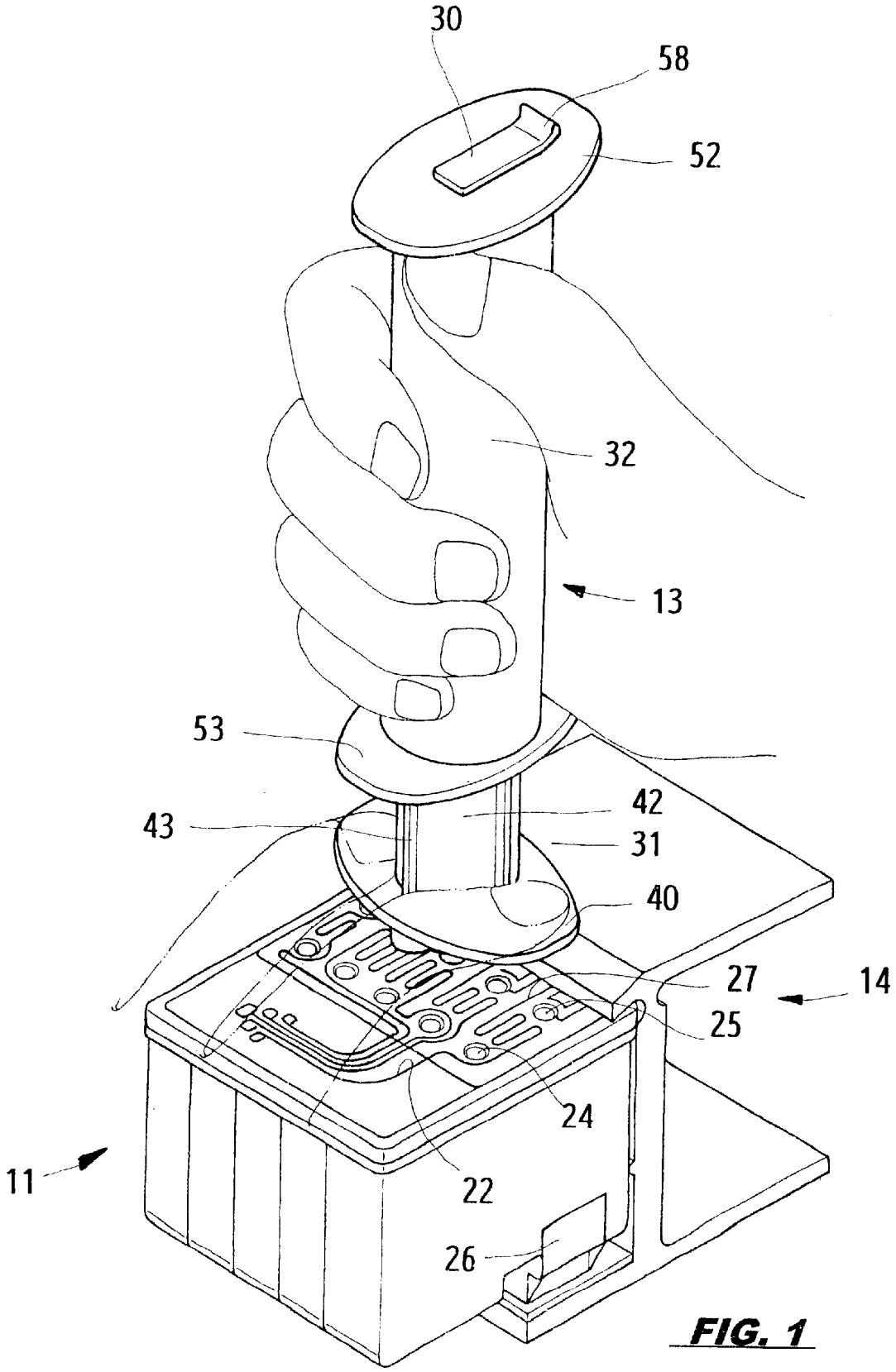
FIG. 1 is a perspective view of the present invention, showing the refilling operation by means of an ink cartridge and an ink-injection cylinder.
Figure 2:
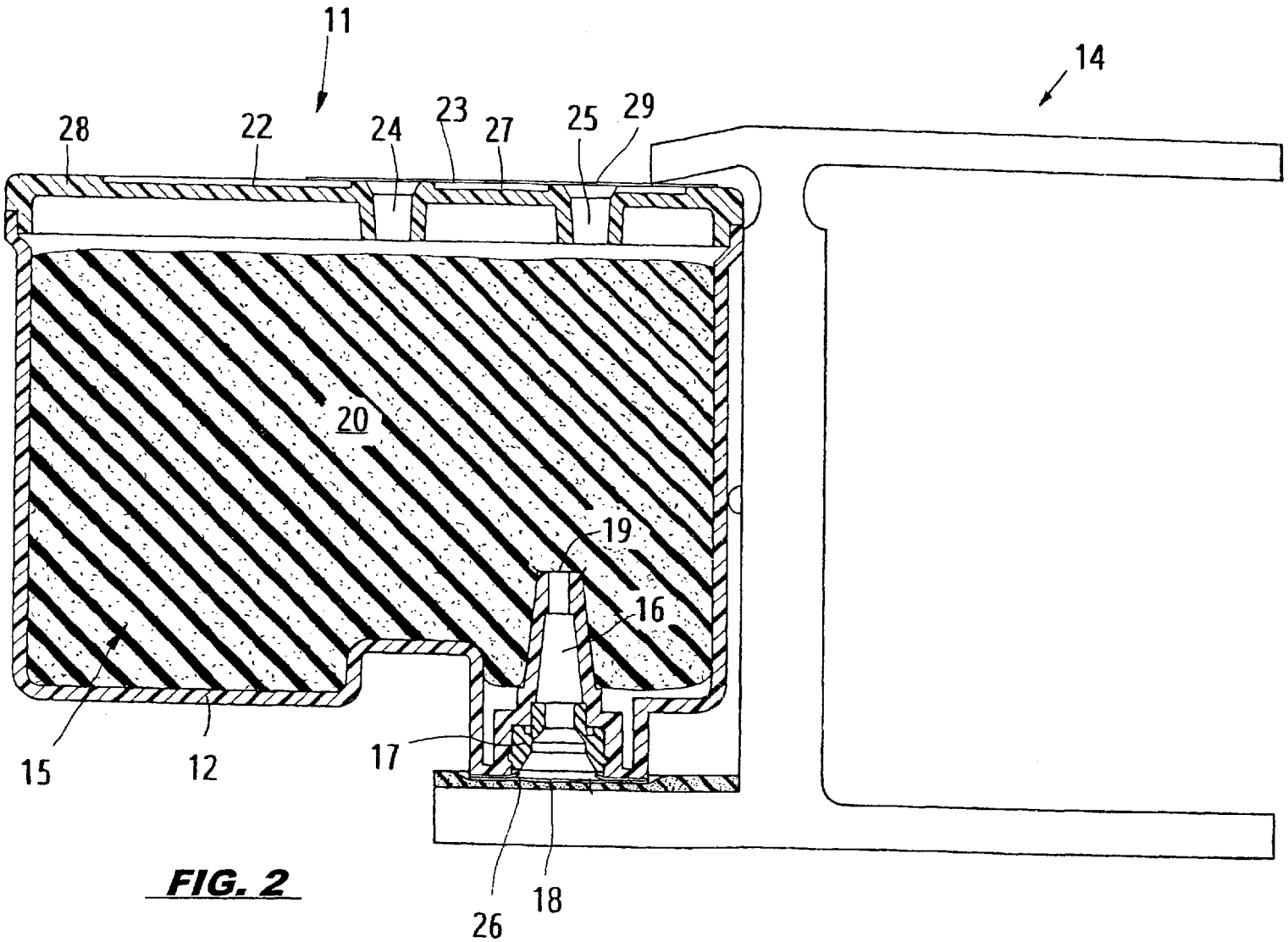
FIG. 2 is a sectional view of the present invention, showing the inner structure of the ink cartridge.
Figure 3:
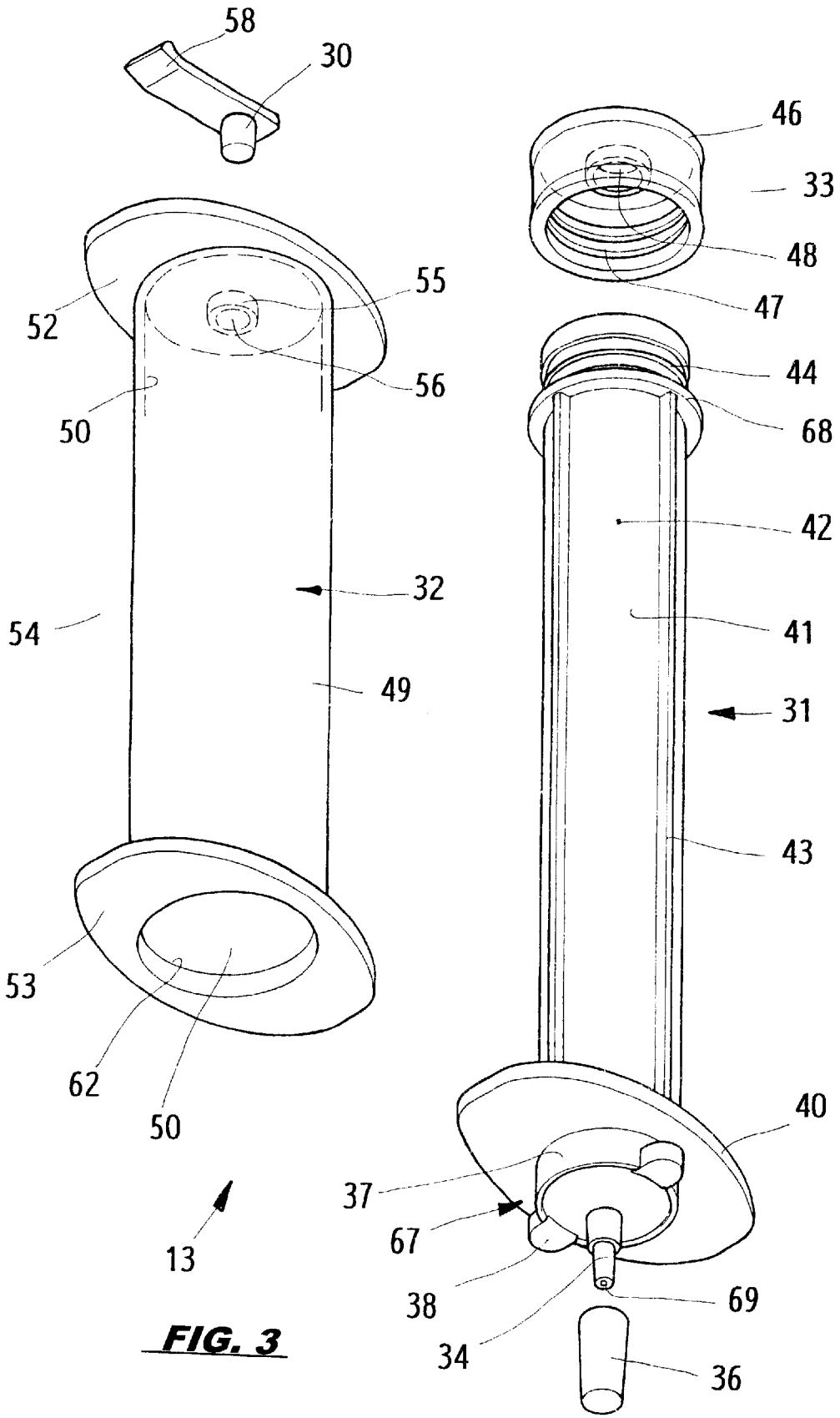
FIG. 3 is a disassembled view of the present invention, showing the assembled structure of the refilling unit.

Referring to FIGS. 1 to 2, an ink cartridge 11 of Epson color jet printer (S020110) is shown. The inner space of the body part 12 of the ink cartridge 11 includes several isolated ink-storage chambers 15 in accordance with different colors of ink; every ink-storage chamber 15 is loaded with a sponge 20; the lower part of every ink-storage chamber 15 is mounted with a mesh 19 to isolate the second chamber 16 so as to prevent the impurities of ink in the ink-storage chamber 15 from entering the second chamber 16. By means of siphon effect, the ink can flow into the second chamber 16 of each ink-storage chamber 15; the second chamber 16 is not a large one. When assembling the ink cartridge 11, a hermetic gasket 17 is first mounted in the second chamber 16 on the output port of the ink cartridge 11; the end opening thereof is sealed with an isolation film 18, and then a sponge 20 is loaded in the ink-storage chamber 15 of every body part 12. The top of the body part 12 is sealed with a cap, of which the top surface 28 is furnished with a plurality of maze grooves 22 in accordance with the corresponding number of the ink-storage chambers 15. The tail end of every maze groove 22 has a through hole 25 in communication with the chamber 15, and another through hole 24 for replenishing ink, i.e., the top surface 28 is furnished with two through holes 24 and 25; the prime object thereof is that the through hole 24 is used for plugging an ink needle into the sponge 20. The ink needle and the through hole 24 are connected together hermetically; the other end of the through hole 25 is connected hermetically with an independent connector of a vacuum sucking assembly. The ink can be directed to flow into the sponge 20 in the ink-storage chamber 15 of the ink cartridge 11 by means of a vacuum sucking force of a vacuum sucking assembly, and simultaneously the air in the sponge 20 and the second chamber 16 will be exhausted. After the top surface 28 of the cap on the ink cartridge 11 is sealed thermally with a membrane 23, the two through holes 24 and 25, and the maze groove 22 will be formed into a maze passage 27. The ink storage chamber 15 of the ink cartridge 11 will be in communication with the atmosphere via the fine maze passage 27. The sponge 20 in the ink-storage chamber 15 provides a function of sucking ink and of balancing the inner pressure of the ink-storage chamber 15. Before the ink cartridge 11 being used, the maze passage 27 of the top surface 22 would not cause ink to be leaked out. After the ink cartridge 11 and the printer are assembled together, the isolation film 18 attached to the output port will be stabbed through by the guide straw of the connecting seat; then, the hermetic gasket 17 of the output port will be in close contact with the guide straw of the connecting seat. The ink soaked in the sponge 20 of the ink-storage chamber 15 will be consumed and reduced upon printing operation being under way until the sponge 20 unable to supply ink via the mesh 19 and to enter the second chamber 16; then, the ink cartridge should be replaced with a new one so as to provide the printer with ink continuously.

In fact, the isolation film 18 attached to the output port will be broken upon replenishing ink for the ink cartridge 11 with sponge 20. After the ink cartridge 11 is separated from the connecting seat of the printer, air will enter the second chamber 16 of the ink cartridge 11.When replenishing ink, the output port of the ink cartridge 11 must be sealed with a glue paper 62, which is glued over the isolation film 18. In order to seal the output port of the ink cartridge 11 surely, a protection clamp 14 is used during replenishing ink so as to have the output port sealed correctly.

Referring to FIGS. 1 to 6, a refilling unit is provided for the ink cartridge of the jet printer according to the present invention; after the ink cartridge 11 is empty, the outlet of the second storage chamber 16 of the ink cartridge 11 is sealed with a glue paper 26; then, the outlet of the ink cartridge 11 is clamped with a protection clam 14 so as to prevent the outlet from leaking ink. The filling nozzle 34 on the front end of the refilling unit 13 can be used to stab through the membrane 29 on the through hole 25 of the ink cartridge 11 after the ink cartridge 11 being clamped in place; then, let the filling nozzle 34 and the through hole 25 contact together hermetically; use two fingers of one hand to press the finger-press plate 40 under the ink cylinder 31, while the other hand should hold the vacuum cylinder 32, and pull the vacuum cylinder 32 upwards so as to provide a negative pressure in the vacuum cylinder 32; in that case, the air in the storage chamber 15 of the ink cartridge 11 will be sucked into a hollow space 51 in the upper portion of the ink cylinder 31. As soon as the pulling force of the vacuum cylinder 32 is removed, the ink in the ink cylinder 31 will flow by means of a vacuum effect so as to have the ink filled into the ink sponge 20 in the storage chamber 15 of the ink cartridge 11.

Referring to FIGS. 3 to 6, the refilling unit 13 includes an ink cylinder 31 and a vacuum cylinder 32; the ink cylinder 31 has a cylinder body 42, of which the center is furnished with an inner cylinder 41; the upper end of the inner cylinder 41 is provided with a retaining ring 44 to be connected with a leaking-proof ring 33 so as to connect together with a retaining groove 47.The outer surface of the cylinder body 42 is furnished with a plurality of symmetrical rib-like plates 43; the lower end of the cylinder body 42 is provided with two symmetrical finger-press plates 40; the lower side of the finger-press plates 40 has a short cylindrical post 37 with two symmetrical lugs 38 extended horizontally. The center of the cylindrical post has a filling nozzle 34, which can be seated with an end plug 36. After the vacuum cylinder 32 is mounted over the outer surface of the ink cylinder 31, the inner cylinder 50 will be in hermetic contact with the leak-proof ring 33 on the upper end of the ink cylinder 31; both the upper and lower ends of the cylinder body 49 are furnished with two sliding stops 52 and 53 respectively. The outer surface of the cylinder body 49 is substantially a handle 54 to be gripped by a user. When the vacuum cylinder 32 is pulled upwards, the inside of the vacuum cylinder 32 will become vacuum so as to provide a force for the ink cartridge upon refilling ink.

The ink cylinder 31 of the refilling unit 13 as shown in FIGS. 1, 3 to 6 includes the cylinder body 42, a retaining assembly 67 and the leak-proof ring 33; the cylinder body 42 is substantially an elongate cylinder, of which of hollow space is used as an ink-storage space 66. The outer edge of one end of the cylinder body 42 has a retaining ring 44 to be connected with a leak-proof ring 33; the other end of the cylinder body 42 is furnished with a retaining assembly 67 to be connected together with a protection box 65 upon refilling ink, and to connect with the filling hole of the ink cartridge. One end of the ink cylinder body 42 of the ink cylinder 31 has a retaining ring 44 with a stop ring 68. The retaining ring 44 is to be connected with a leak-proof ring 33; the stop ring 68 underneath the retaining ring 44 is used for preventing the leak-proof ring 33 from sliding, i.e., to hold the ring 33 in place.

The cylinder body 42 of the ink cylinder 31 is to be mounted with the inner cylinder 50 of the vacuum cylinder 32; the outer surface of the cylinder body 42 is furnished with a plurality of longitudinal rib-like plates 43 to facilitate the vacuum cylinder 32 to move without bias. The rib-like plates 43 extend downwards from the stop ring, and have a gap between the ink cylinder 31 and the vacuum cylinder 32 reduced to minimum.

The lower end of the cylinder body 42 has a retaining assembly 67, which includes a symmetrical finger-press plate 40, a cylindrical part 37, two symmetrical lugs 38 and a filling nozzle 34. The cylindrical part 37 on one end of the cylinder body 42 extends out of the inner cylinder 41 of the cylinder body 42, and the center thereof has a through hole 69, which is substantially a passage of the filling nozzle 34. The finger-press plate 40 above the cylindrical part 37 extends from two symmetrical sides of the cylinder body 42, and the top surface thereof is a wide and flat surface; during refilling ink, two fingers of a user may press the plate 40 so as to have the ink cylinder 31 stopped in place. The cylindrical part 37 under the finger-press plate 40 has a filling nozzle 34, of which the outer diameter is designed to fit the inner diameter of the through hole 25 of the ink cartridge 11 so as to provide a hermetically connection between the filling nozzle 34 and the through hole 25 of the ink cartridge 11.

Figure 7:
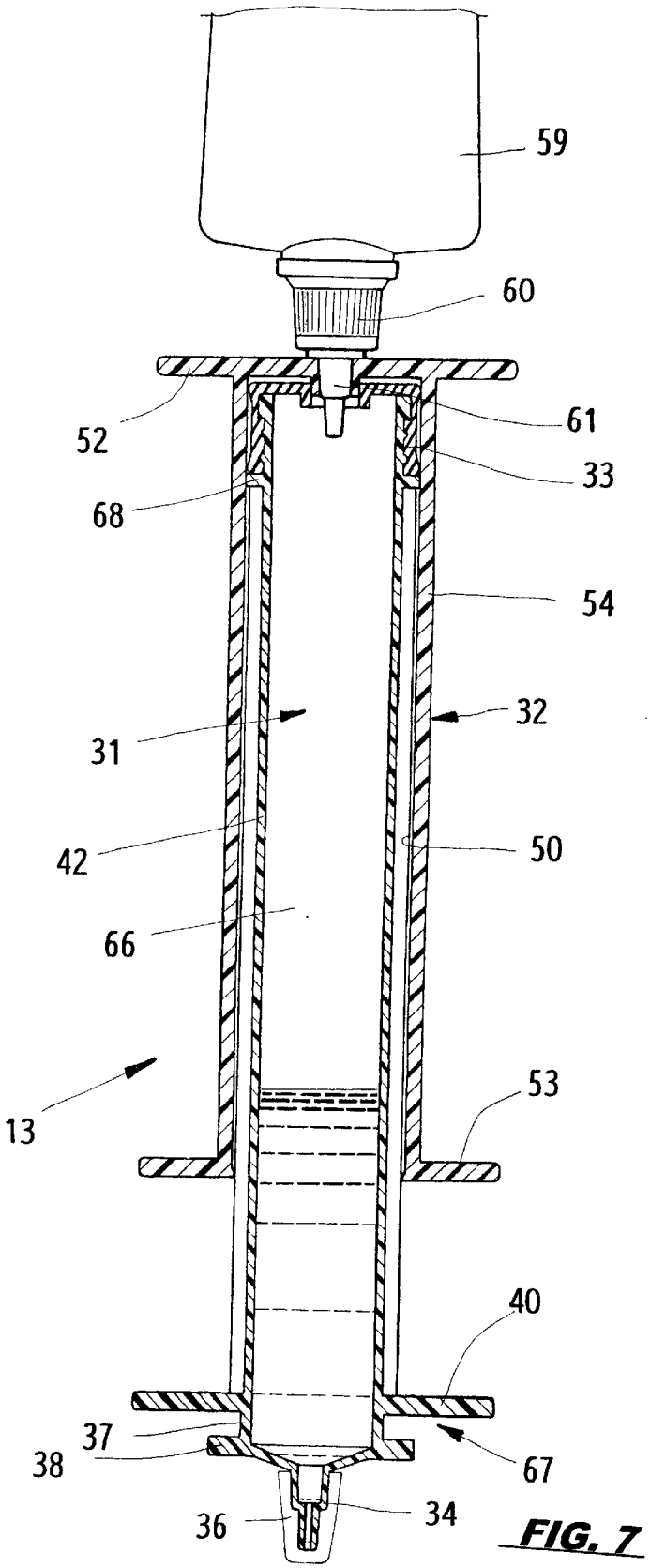
FIG. 7 is a sectional view of the present invention, showing the refilling unit replenishing ink.
Figure 8:
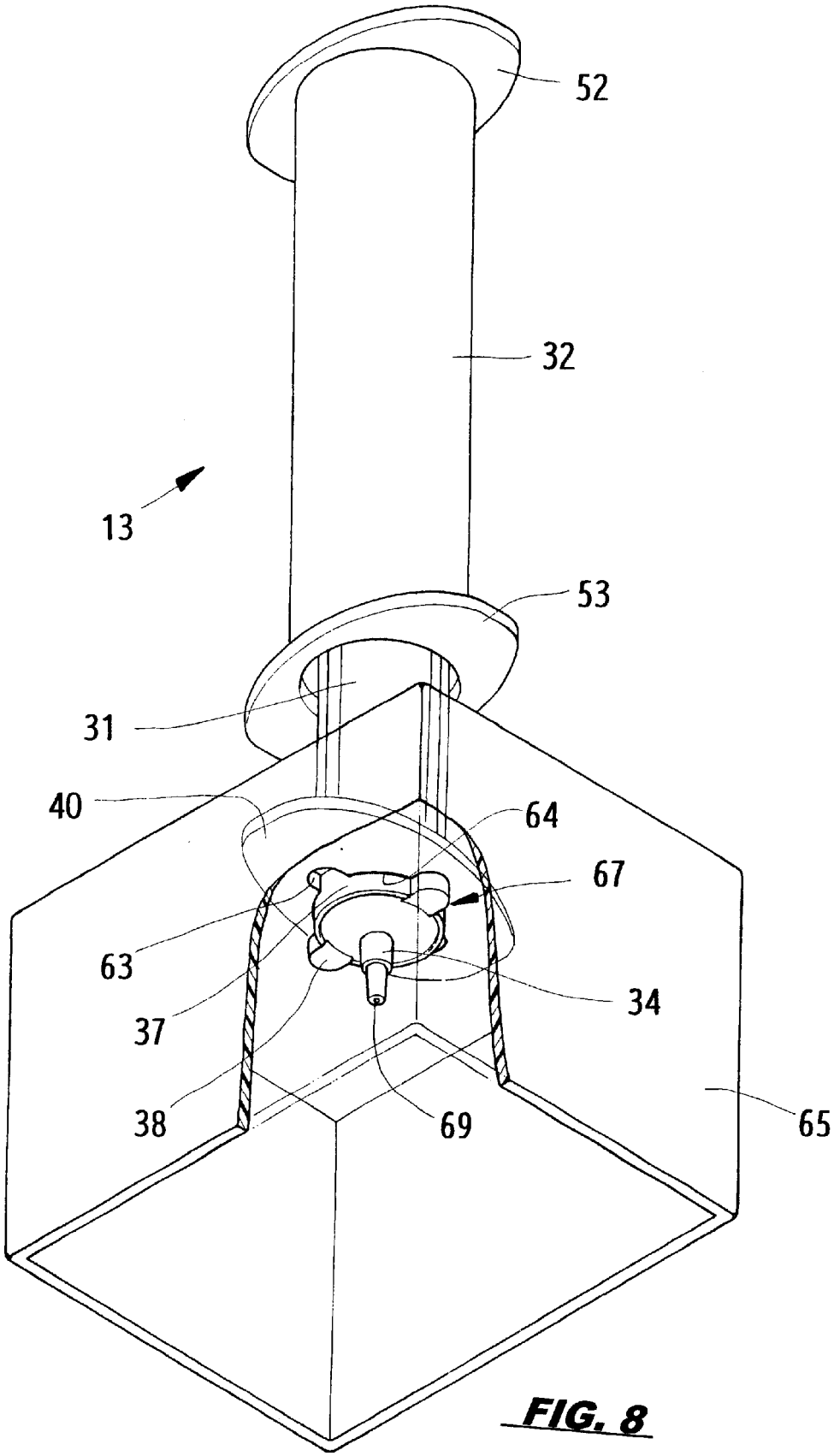
FIG. 8 is a perspective view of the present invention, showing the connection relation between the refilling unit and the protection box.
Figure 9:
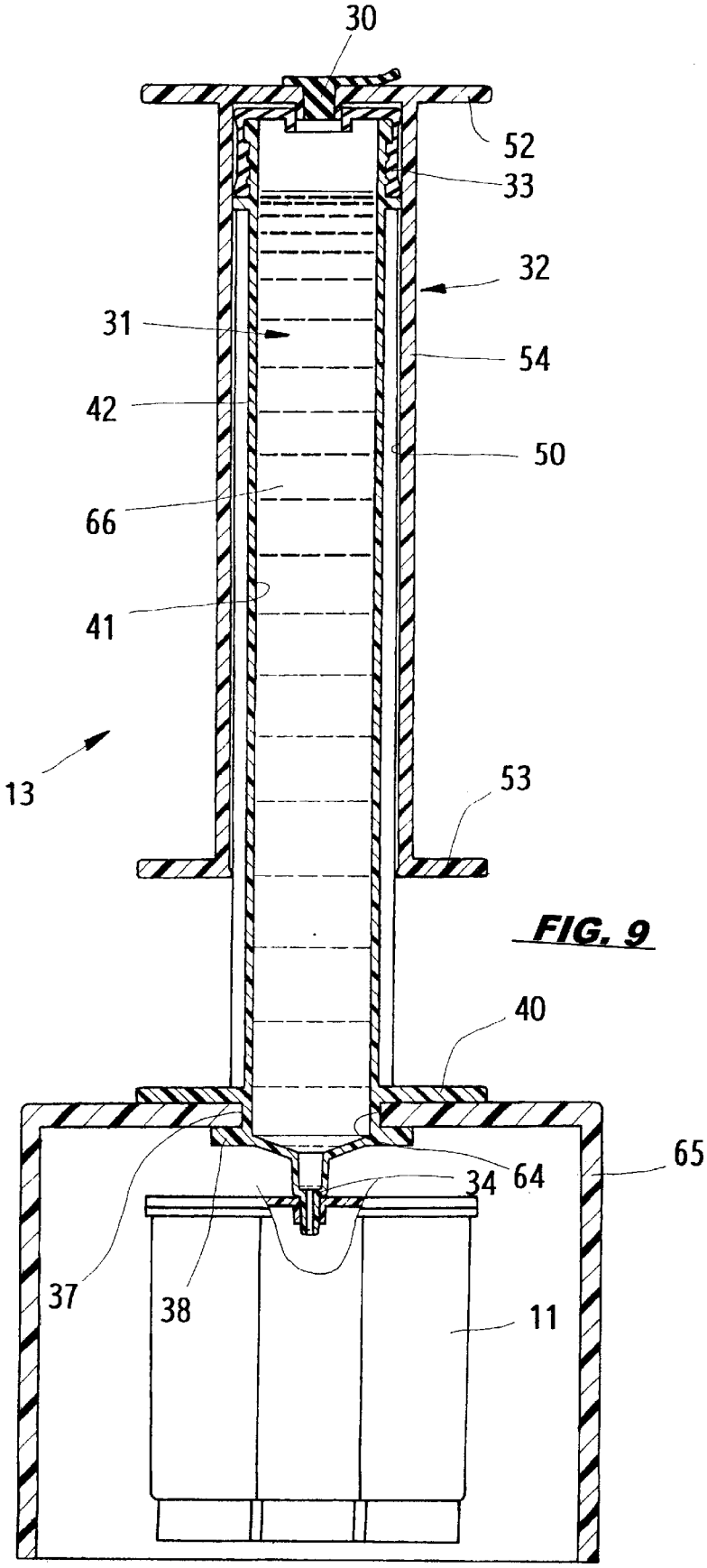
FIG. 9 is a sectional view of the present invention, showing the connection relation between the refilling unit and the protection box.

In order to have a sure and safe connection during refilling the ink cartridge 11, the outer end of the cylindrical part 37 of the cylinder body 42 is furnished with two symmetrical lugs 38, which are designed into a round shape; as shown in FIGS. 7 to 9, the lugs are to be mated with a connection hole 63 of the protection box 65, i.e., the lugs 38 pass through a retaining groove 64 of the connection hole 63, and then turn so as to have the protection box 65 connected with the retaining assembly 67 of the ink cylinder 31. The filling nozzle 34 passed through the connection hole 63 of the protection box 65,i.e., the lugs 38 pass through a retaining groove 64 of the connection hole 63, and then turn so as to have the protection box 65 connected with the retaining assembly 67 of the ink cylinder 31. The filling nozzle 34 passed through the connection hole 63 of the protection box 65 extends into the hollow space of the protection box 65 so as to facilitate the connection with the through hole 25 of the ink cartridge 11 during refilling, i.e., to provide a safe and sure connection.

Figure 5:
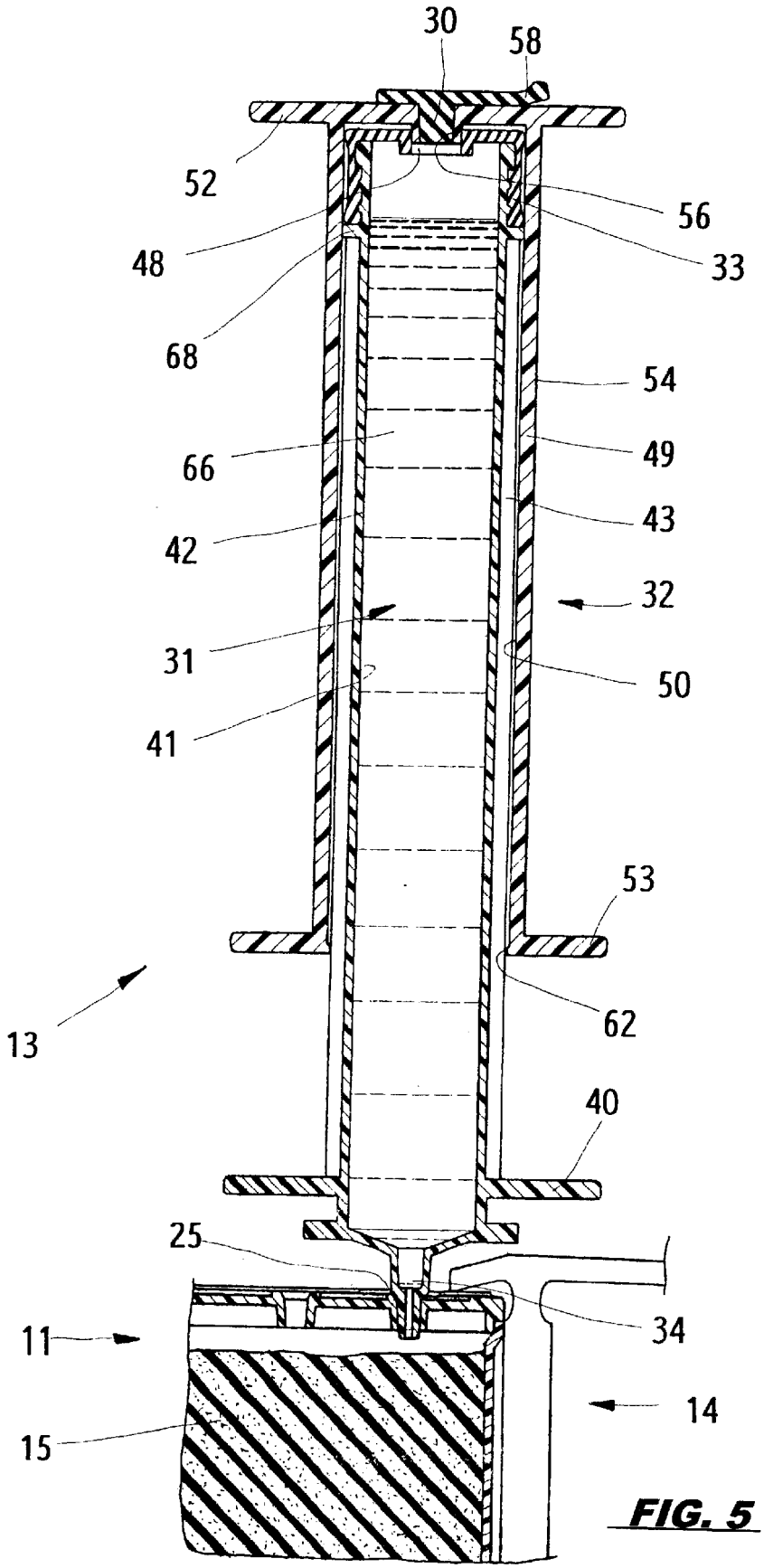
FIG. 5 is a sectional view of the present invention, showing the relation between the refilling unit and the ink cartridge.
Figure 6:
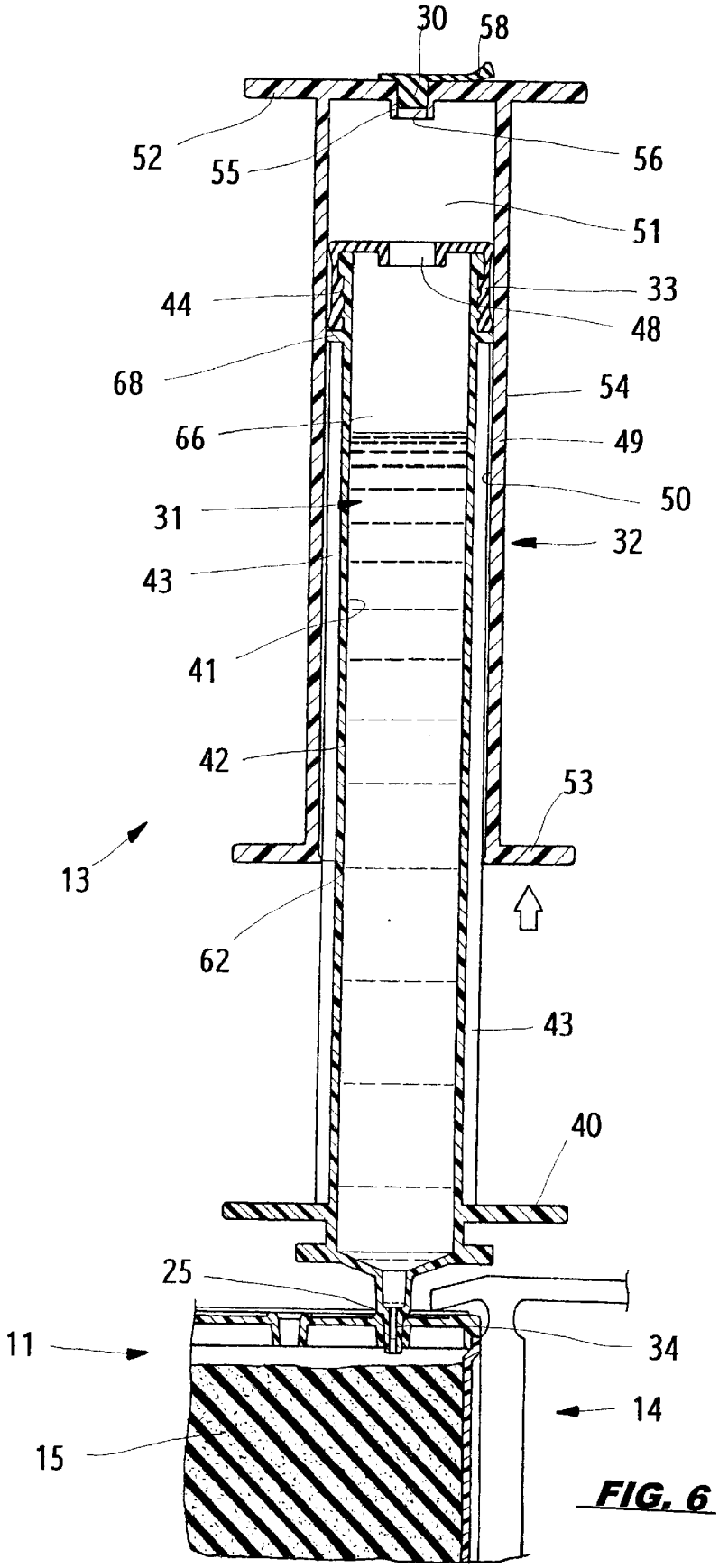
FIG. 6 is a sectional view of the present invention, showing the operation condition of the refilling unit.

The retaining part 67 under the finger-press plate 40 has a cylindrical part 37, of which the center has a filling nozzle 34. As shown in FIGS. 5 and 6, the filling nozzle 34 of the ink cylinder 31 can connect directly with the through hole 25 of the ink cartridge 11, and the lugs 38 on the cylindrical part 37 have no any use; therefore, the lugs 38 on the cylindrical part 37 may be omitted.

The retaining assembly 67 of the ink cylinder 31, as shown in FIGS. 7 to 9, is to be connected first with the protection box 65. The retaining assembly 67 of the ink cylinder 31 needs the lugs 38 on both sides of the cylinder part 37 so as to provide a retaining function after connection; in other words, there will be no ink leaking and splashing after the filling nozzle 34 being connected together with the through hole 25 of the cartridge for refilling.

The vacuum cylinder 32 mounted over the ink cylinder 31 has a shorter cylinder body 49, which has an inner cylinder 50 to be in contact with the leak-proof ring 33 of the ink cylinder 31; the lower end of the inner cylinder 50 has a limit ring 62 to prevent the ink cylinder 31 and the vacuum cylinder 32 from separating each other upon the vacuum cylinder 32 moving normally. Both the upper and lower ends of the cylinder body 49 are furnished with two symmetrical sliding stops 52 and 53 respectively, which can prevent a user's hand from slipping off upon pulling the vacuum cylinder 32; it is particularly true upon a negative pressure taking place in the inner cylinder 50 during pulling the vacuum cylinder 32; i.e., the hand would feel not slippery.

One end of the inner cylinder 50 of the vacuum cylinder 32 to connect with the ink cylinder 31 is a round opening end, while the other end thereof is a closed end, of which the center is furnished with a short post 55 having a through post hole 56 being normally closed with a hole plug 30. After the vacuum cylinder 32 and the ink cylinder 31 are connected together, the inner cylinder 50 and the leak-proof ring 33 of the ink cylinder 31 will be in contact together; then, the ink filled in the ink cylinder 31 would not leak out because of the filling nozzle 34 being closed with an end plug.

Figure 4:
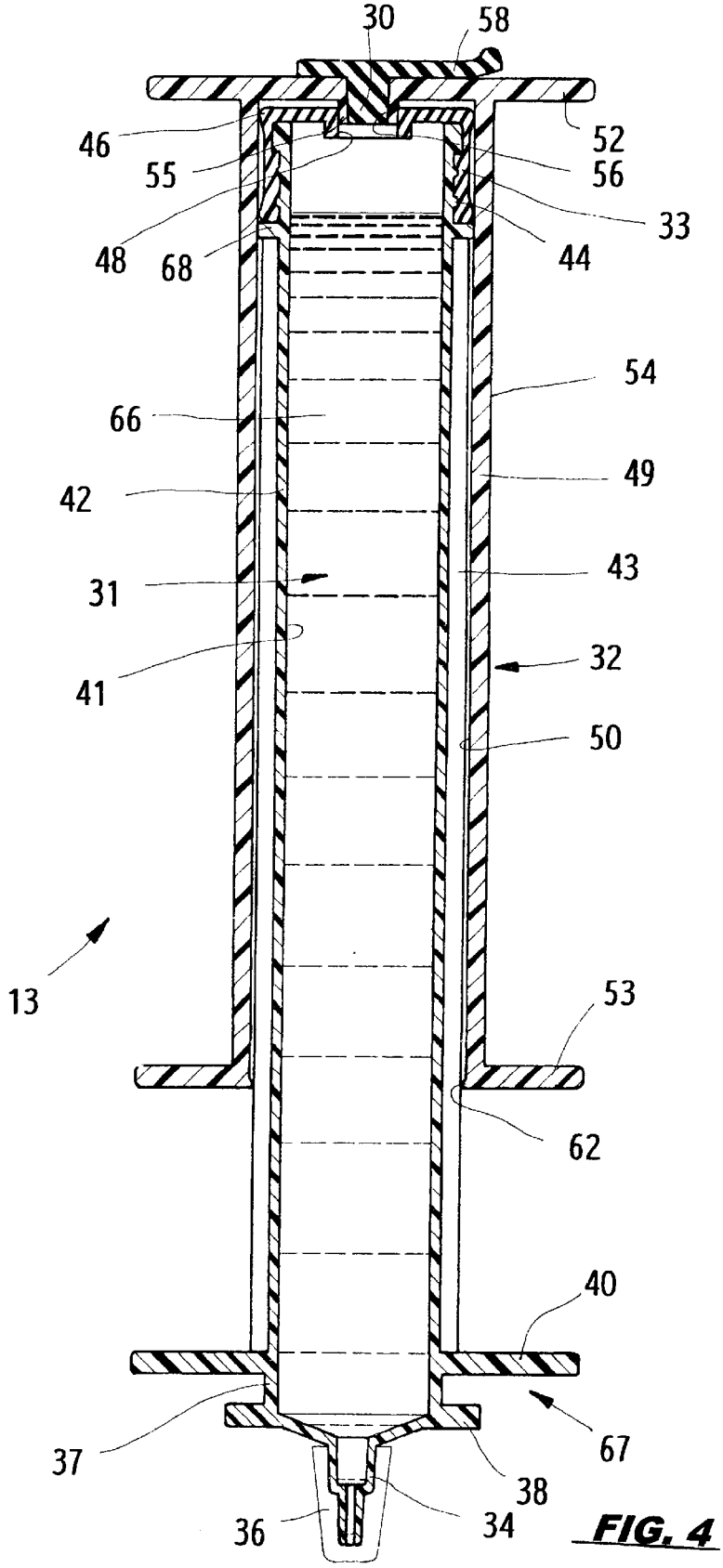
FIG. 4 is a sectional view of the present invention, showing the assembled structure of the refilling unit.

The post hole 56 on the upper end of the vacuum cylinder 32 has a short post 55 extended into the inner cylinder 50 so as to elongate the post hole 56. As shown in FIG. 4, the filling nozzle 34 of the ink cylinder 31 is closed with an end plug 36 before filling ink into the refilling unit 13; the other end of the ink cylinder 31 is mounted with the vacuum cylinder 32, and the short post 55 of the post hole 56 will be plugged into the through hole 48 of the leak-proof ring 33; the outer surface of the short post 55 will be in close contact with the through hole 48 of the leak-proof ring 33; then, the post hole 56 of the vacuum cylinder 32 will be in communication with the inner cylinder 41 of the ink cylinder 31. When refilling ink, the connection nozzle can be plugged into the inner cylinder 41 of the vacuum cylinder 32 directly so as to have the refilling operation done quickly. As soon as the refilling operation is done, close the post hole 56 of the vacuum cylinder 32 by using the hole plug 30 of the pull plate 58, and then the refilling operation of the refilling unit 13 is done completely. Both ends of the refilling unit 13 are to be closed by means of the end plug 36 and the hole plug 30 respectively so as to prevent from leakage during shipping or handling.

During refilling the ink cartridge, as shown in FIGS. 4 to 6, the end plug 36 of the ink cylinder 31 should be removed first, and then the filling nozzle 34 is plugged into the through hole 25 of the ink cartridge 11 to have connection surface contacted together closely. As shown in FIGS. 7 to 9, the retaining assembly 67 at one end of the ink cylinder 31 passes through the connection hole 63 of the protection box 65 so as to connect firmly each other until the filling nozzle 34 being connected with the through hole 25 of the ink cartridge 11. As shown in FIG. 1, use two fingers of one hand to put and press the finger-press plate 40 on the lower part of the ink cylinder 31, while the other hand holds the cylinder body 49 of the vacuum cylinder 32 to pull the vacuum cylinder 32 upwards; as shown in FIG. 6, the closed space between the refilling unit 13 and the ink cartridge 11 will be increased, and a negative pressure will be produced in that closed space; as a result, the ink in the refilling unit 13 will be refilled therein by means of that negative pressure and a convection effect.

After the vacuum cylinder 32 of the refilling unit 13 is pulled to move, and a negative pressure will be produced in the closed space; in that case, user's hand would feel a vacuum sucking force existing; a considerable pulling back force will occur between the ink cylinder 31 and the vacuum cylinder 32. The sliding stops 52 and 53 on both ends of the cylinder body 49 of the vacuum cylinder 32 are used for preventing the hand from sliding off during pulling operation. When the vacuum cylinder 32 is pulled, the hollow space between the ink cartridge 11 and the vacuum cylinder 32 will produce a negative pressure; in the very starting instant, the air in the ink sponge 20 of the ink cartridge 11 will be sucked into the vacuum cylinder 32, and simultaneously, the closed space is under a negative pressure condition; then, the air in the upper part of the ink cylinder 31 will be increased. As soon as the vacuum cylinder 32 of the refilling unit 13 is released, the vacuum cylinder 32 will be pulled back as a result of the negative pressure, and the ink in the ink cylinder 31 will be sucked, by a vacuum force, into the storage chamber 15 of the ink cartridge 11 to be absorbed into the ink sponge 20. Pull the vacuum cylinder 32 of the refilling unit 13 repeatedly until no more ink being sucked out of the ink cartridge 11; then, the refilling operation will be done by means of a vacuum convection method; simultaneously, the air bubbles in the ink sponge 20 will be sucked out by means of the vacuum force. After the ink cartridge 11 is filled with ink, the through hole 25 of the storage chamber 15 should be attached with a glue paper to cover the membrane 23 on the through hole 25 so as to restore the original function of the maze passage 27.

Referring to FIG. 7, when the ink in the refilling unit 13 is used up, or insufficient during refilling operation, the hole plug 30 on the vacuum cylinder 32 should be pulled out by holding the pull plate 58 so as to replenish ink through the post hole 56 of the vacuum cylinder 32 into the ink bottle 59; the connection part 61 of the bottle cap 60 is to be connected with the post hole 56 of the vacuum cylinder 32 so as to have the ink in the ink bottle 59 filled into the ink cylinder 31 of the refilling unit 13; the refilling unit 13 can be used repeatedly.

One end of the ink cylinder 31 according to the present invention has a filling nozzle 34, while the other end thereof has a leak-proof ring 33, of which the outer surface is mounted with a vacuum cylinder 32. One end of the vacuum cylinder 32 has an ink-filling hole for filling ink after the ink cylinder 31 and the vacuum cylinder 32 being connected together. To fill ink into the ink cartridge 11, a user may use two fingers of one hank to press the finger-press plate 40 on the lower end of the ink cylinder 31, while the other hand holds the cylinder body 49 of he vacuum cylinder 32 to pull it upwards so as to produce a negative pressure in the close space between the refilling unit 13 and the ink cartridge 11, and have the air in the ink cartridge sucked out; when the vacuum cylinder 32 is restored in balance condition, the ink in the ink cylinder 31 will be filled into the storage chamber 15 of the ink cartridge 11, and absorbed in the ink sponge 20; after pulling several times, there will be no bubbles or air left in the ink sponge 20 and the second storage chamber 16 of the ink cartridge 11. According to the aforesaid description of the embodiment, the features of ink refilling method for the ink cartridge and the structure of the ink-injection cylinder have been disclosed completely, and it is apparent that the present invention has provided an evident improvement and novelty as expected; further, such features can not be anticipated and achieved by any persons in the same field.

What is claimed is:

1. An ink-refilling unit for an ink cartridge of a jet printer comprising:

an elongate ink cylinder having a hollow inner space for storing ink, a first end of said ink cylinder having a retaining ring adapted to be connected with a leak-proof ring, and a second end thereof having a finger-press plate and a filling nozzle;

a leak-proof ring connected with said retaining ring of said ink cylinder, a center of the leak-proof ring having a through hole;

an elongate vacuum cylinder, a first end thereof being open to accommodate said ink cylinder therein whereby said vacuum cylinder is in close contact with said leak-proof ring of said ink cylinder, a center of a second, closed end of said vacuum cylinder having a post hole;

a hole plug removably mounted in the post hole in said vacuum cylinder; and, an end plug removably mounted on the filling nozzle of said ink cylinder.

2. The ink-refilling unit for an ink cartridge of a jet printer as claimed in claim 1, wherein an outer surface of the first end of said ink cylinder has a retaining ring with a stop ring, said retaining ring connected together with the leak-proof ring.

3. The ink-refilling unit for an ink cartridge of a jet printer as claimed in claim 2, wherein an outer surface of said ink cylinder has a plurality of longitudinal rib plates, which extend from a lower side of said stop ring to an upper side of said finger-press plate.

4. The ink-refilling unit for an ink cartridge of a jet printer as claimed in claim 1, further comprising a short cylindrical post extending from the finger-press plate.

5. The ink-refilling unit for an ink cartridge of a jet printer as claimed in claim 4, wherein said short cylindrical post has two symmetrical lugs such that said finger-press plate, said cylindrical post and said symmetrical lugs form a retaining assembly, adapted to be connected with a connection hole of a protection box.

6. The ink-refilling unit for an ink cartridge of a jet printer as claimed in claim 1, further comprising a through hole in a center of the leak-proof ring, wherein the second, closed end of said vacuum cylinder has a short post with the post hole in a center thereof, said short post adapted to be p lugged into the through hole in a center of said leak-proof ring such that an outer surface of said short post is in close contact with said through hole of said leak-proof ring.

7. The ink-refilling unit for an ink cartridge of a jet printer as claimed in claim 1, wherein said hole plug has a pull plate to facilitate removal of said hole plug.

8. An ink-refilling unit for ink cartridge of a jet printer comprising:

an elongate ink cylinder having a hollow inner space for storing ink, a first end of said ink cylinder having a retaining ring adapted to connect with a leak-proof ring, a second end of said ink cylinder having a finger-press plate, and a filling nozzle in a center thereof;

a leak-proof ring mounted over said retaining ring by a retaining groove in said leak-proof ring, said leak-proof ring having a through hole in a center thereof; and, an elongated vacuum cylinder having a first end being open to accommodate said ink cylinder therein, whereby said vacuum cylinder is in close contact with said leak-proof ring mounted on said ink cylinder.

9. The ink refilling unit for an ink cartridge of a jet printer as claimed in claim 8, wherein a second end of said vacuum cylinder is closed and has a short post with a post hole in a center thereof, and said post hole being sealed with a hole plug.

10. The ink refilling unit for an ink cartridge of a jet printer as claimed in claim 8, wherein a second end of said vacuum cylinder has a symmetrical finger-press plate; a short cylindrical post furnished under said finger-press plate and having two symmetrical lugs, whereby said finger-press plate, said cylindrical post and said symmetrical lugs form a retaining assembly adapted to connect together with a connection hole of a protection box.

* * * * *